US006384005B1

(12) United States Patent
Woo et al.

(10) Patent No.: US 6,384,005 B1
(45) Date of Patent: May 7, 2002

(54) GARMENT CONDITIONING COMPOSITION

(75) Inventors: Ricky Ah-man Woo, Hamilton; Donald Scott Adams; Bruce Albert Yeazell, both of Cincinnati; Daniel Scott Cobb, Loveland; Jacqueline Marie Duderstadt; Stephen Gary Bush, both of Cincinnati, all of OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/673,600

(22) PCT Filed: Apr. 27, 1998

(86) PCT No.: PCT/US99/08124

§ 371 Date: Oct. 18, 2000

§ 102(e) Date: Oct. 18, 2000

(87) PCT Pub. No.: WO99/55816

PCT Pub. Date: Nov. 4, 1999

(51) Int. Cl.[7] ..... C11D 14/02; C11D 1/04; C11D 3/00; D06L 14/02; D06M 3/00

(52) U.S. Cl. ..... 510/328; 510/276; 510/292

(58) Field of Search ..... 510/276, 292, 510/328

(56) References Cited

U.S. PATENT DOCUMENTS

| | | | | | |
|---|---|---|---|---|---|
| 3,900,606 | A | * | 8/1975 | Mandell | 427/155 |
| 4,643,919 | A | * | 2/1987 | Fu | 427/393.1 |
| 4,761,305 | A | * | 8/1988 | Ociai | 427/180 |
| 5,089,148 | A | * | 2/1992 | Blarcom et al. | 252/8.6 |

FOREIGN PATENT DOCUMENTS

| | | | |
|---|---|---|---|
| FR | 1 503 505 | * | 2/1968 |
| WO | WO 96 05196 | * | 3/1993 |

* cited by examiner

*Primary Examiner*—Yogendra N. Gupta
*Assistant Examiner*—John M. Petruncio
(74) *Attorney, Agent, or Firm*—C. Brant Cook; Kim W. Zerby; Steve W. Miller

(57) ABSTRACT

A conditioning composition for garments to be used before or after conventional washing and drying operations is disclosed. The compositions are suitable for conditioning dry clean only garments. The composition is an aqueous mixture containing a garment conditioning agent wherein the mixture has a fluid viscosity of from about 1 cps to about 100 cps and a fluid surface tension of from about 20 dynes/cm to about 55 dynes/cm. The conditioning composition is in fog form to improve composition deposition on the garments.

13 Claims, No Drawings

GARMENT CONDITIONING COMPOSITION

This application is a 371 of PCT/US98/8124 filed Apr. 27, 1998.

FIELD OF THE INVENTION

The present invention relates to a garment conditioning composition which can be applied directly on a garment in a wide variety of appliances such as a cabinet-type apparatus. The conditioning composition "conditions" garments in that they are cleaned, refreshed, de-wrinkled, deodorized, or softened as a result of being subjected to the conditioning composition. The conditioning composition of the invention is especially suitable for garments which require only dry cleaning and/or are susceptible to damage during conventional home laundering operations.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments. In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape.

One type of home dry cleaning system comprises a carrier sheet containing various cleaning agents, and a plastic bag. The bag can be either sealed such that it is substantially air tight or the bag can be vapor venting. The garments to be cleaned are sealed in the bag together with the sheet, and then tumbled in a conventional clothes dryer. In a commercial embodiment, multiple single-use flat sheets and a single multi-use plastic bag are provided in a package. However, the bag requires storage between uses and it can substantially increase the cost of the dry cleaning kit. Moreover, the bag restricts the number/volume of articles that can be dry cleaned and only partially assists in de-wrinkling the articles. Thus, there is a need for a dry cleaning/refreshing system which can be used in addition to, or as an alternative to, the aforementioned dry cleaning system, but which retains the convenience of achieving such dry cleaning in the user's home.

The art has suggested methods by which such goals can be accomplished. For example, the prior art discloses a method of finishing garments by hanging them in a sealed chamber, spraying a finishing agent which imparts refreshing and cleaning benefits, and thereafter or simultaneously therewith, fully applying steam to the garments. In a final step, hot air is blown through the sealed chamber to dry the garments. This system has the drawback of requiring the addition of "steam" to impart the desired benefits. The "full steaming" requirement of this process unnecessarily adds to the cost and time associated with refreshing and cleaning the garments. Thus, it would be desirable to have a composition which can be used to refresh, de-wrinkle and/or clean garments without requiring a steam application step.

Accordingly, despite the numerous disclosures in the prior art, there remains a need for a conditioning composition that can conveniently condition fine-washable garments in the consumer's home. There is also a need for such a composition that has improved cost and time effectiveness in that steam application is not required for effective conditioning of the garment.

BACKGROUND ART

Methods of finishing clothes is disclosed in: U.S. Pat. No. 4,761,305 issued Aug. 2, 1988 to Ochiai; U.S. Pat. No. 4,519,222, issued Mar. 28, 1985 to Kannegiesser et al; and U.S. Pat. No. 4,391,602, issued Jul. 5, 1983 to Stichnoth et al. Dry cleaning processes are disclosed in: U.S. Pat. No. 5,547,476 issued Aug. 20, 1996 to Siklosi & Roetker; U.S. Pat. No. 5,591,236 issued Jun. 7, 1997 to Roetker; U.S. Pat. No. 5,630,847 issued May. 20, 1997 to Roetker; U.S. Pat. No. 5,630,848 issued May 20, 1997 to Young, et al.; and in U.S. Pat. No. 5,632,780 issued May 27, 1997 to Siklosi.

SUMMARY OF THE INVENTION

The needs in the art identified above are met by the present invention which provides a conditioning composition for application to garments before or after conventional washing and drying operations. Most importantly, the composition is suitable for conditioning dry clean only garments. The composition is an aqueous mixture containing a garment conditioning agent wherein the mixture has a fluid viscosity of from about 1 cps to about 100 cps and a fluid surface tension of from about 20 dynes/cm to about 55 dynes/cm. The conditioning composition is in fog form to improve composition deposition on the garments.

As used herein, the term "conditioning" means cleaning, refreshing, de-wrinkling, deodorizing, softening and/or other fabric benefit which can be imparted to garments. As used herein, the phrase "fog form" means a mist, vapor, gas, atomized droplets, or the like which may contain fine particles. As used herein, the word "cabinet" means any apparatus in which a garment can be placed, wherein the apparatus does not necessarily have to be totally enclosed. As used herein, the term "steam" means water vapor typically at temperatures above 80° C. All percentages, ratios and proportions herein are by weight, unless otherwise specified. All documents cited are, in relevant part, incorporated herein by reference.

DETAILED DESCRIPTION OF THE PREFERRED EMBODIMENT

In its broadest aspect, the invention is directed to a composition which includes a garment conditioning agent wherein the mixture has a fluid viscosity of from about 1 cps to about 100 cps and a fluid surface tension of from about 20 dynes/cm to about 55 dynes/cm. More preferably, the fluid surface tension is from about 20 dynes/cm to about 30 dynes/cm, and most preferably, from about 25 dynes/cm to about 30 dynes/cm. The lower surface tension of the conditioning composition improves effective distribution by improving surface absorption and spreading of the conditioning composition on the garment fabric. It has been found that compositions which have the aforementioned selected fluid surface tension unexpectedly results in more effective spreading of the composition on fabrics such as wool, nylon, acrylics and the like which are typically found in fine washable or dry clean only garments.

Furthermore, it is more preferable for the conditioning composition to have a fluid viscosity of from about 1 cps to about 50 cps, and most preferably, of from about 1 cps to about 20 cps as measured by a standard Brookfield viscometer. Unexpectedly, it has been found that the selection of fluid viscosity in combination with fluid surface tension within the aforementioned ranges result in a composition which can be effectively distributed on the garments to be conditioned. The selection of these two physical parameters of the composition described herein have the greatest effect on the even distribution of the composition onto the garments. In order to achieve the desired conditioning of the garments, even distribution of the composition is important.

A typical conditioning operation using the composition involves hanging dry clean only or laundered garments in a cabinet or similar apparatus in which air is circulating, and spraying an effective amount of a conditioning composition into the cabinet for distribution on the garments. The use of steam to condition the garment is not necessary. More effective distribution of the conditioning composition is achieved by selecting a fog form of the conditioning composition. More preferably, the mean particulate diameter size of the fog is optimally chosen. To that end, the mean particulate diameter size of the conditioning composition fog is preferably from about 3 microns to about 50 microns, more preferably from about 5 microns to about 30 microns, and most preferably from about 10 microns to about 20 microns. Furthermore, it is preferable for the particle diameter size to have a narrow particle size distribution to enhance the distribution of the conditioning composition further. It has been found that a wide variety of other processing parameters as described in detail hereinafter can be optimally selected to ensure effective distribution and deposition of the conditioning composition on the garments as well as deliver other fabric benefits.

The cabinet or other apparatus used in the conditioning operation can take a variety of forms, one of which is an enclosed apparatus having an interior region or space to which a door is hingedly attached. A rod or other hanger means (e.g., one or more hooks) is positioned in the interior region of the cabinet. The cabinet preferably has a lower housing in which a heater and fan are disposed for circulating air within the cabinet, and optionally, heating such circulating air. The conditioning composition of the invention can be effectively distributed on the garments in the cabinet by spraying the composition in fog form having the aforedescribed particle size into the circulating air in the cabinet. Preferably, this spraying step occurs in an unobstructed deceleration zone prior to contacting the garments in the cabinet. In this way, the conditioning composition vapor is allowed to circulate gently in the cabinet air such that it moves freely in, between and around the garments ultimately uniformly distributing itself on the garments. In this regard, it is preferable for the cabinet to have at least about 15 cm, preferably 25 cm or more of "dead" space at the top or front of the cabinet to serve as the unobstructed deceleration zone for the condition composition in the cabinet. This facilitates effective distribution of the conditioning composition on the garments.

For purposes of enhancing the effective distribution of the conditioning composition on the garments and insuring the desired particle size of the composition is achieved, suitable spraying devices such as hydraulic nozzle, sonic nebulizer, high pressure fog nozzle, and the like can be used. However, it is preferably achieved by using a relatively low volume air atomization nozzle. For example, spray nozzles commercially available from Spray Systems, Inc. (Model Nos. 850, 1050, 1250, 1450 and 1650) are most suitable for the process. The spraying step is conducted for a period of time of from about 5 minutes to about 30 minutes, more preferably from about 5 minutes to about 20 minutes. Spraying times will vary depending upon the various operating parameters selected as described herein.

In one mode of operation, the liquid conditioning composition is fogged by combining it with an air stream under pressure and passed through the atomization nozzle in the cabinet. This can be accomplished by using an air stream having a pressure of from about 5 psi (0.35 $kg \cdot cm^2$) to about 30 psi (2.1 $kg \cdot cm^2$). Optionally, the temperature of the air stream and/or the conditioning composition can be raised to enhance distribution and deposition of the conditioning composition on the garments. In that regard, the temperature of the air stream and/or the conditioning composition is preferably from about 40° C. to about S0° C., more preferably from about 40° C. to about 70° C., and more preferably, from about 45° C. to about 50° C. By having the air stream and/or the conditioning composition at the aforementioned elevated temperatures, it has been found that superior de-wrinkling benefits are achieved.

The particular conditioning composition may include a variety of adjunct ingredients depending upon the particular benefit desired. However, in preferable modes of operation the conditioning composition will contain adjunct ingredients which can be effective across a variety of garment fabrics. For example, the conditioning composition will preferably be suitable for "dry-clean" only garments as well as pure cotton dress shirts which typically require a significant de-wrinkling operation subsequent to conventional laundering operations (i.e. home washing and drying cycles). By way of example, one suitable composition which provides deodorizing, refreshing and de-wrinkling benefits comprises, by weight, from about 0.001% to about 10% of a refreshing a copolymer of acrylic acid and t-butylacrylate (which may be silicone grafted); from about 0.001% to about 10% of a diethylene glycol; from about 0.01% to about 10% of a beta cyclodextrin; from about 0.001% to about 5% of a surfactant; from about 0% to about 2% of a preservative; and the balance water.

A preferred level of the polymer is from about 0.1% to about 1%, more preferably from about 0.3% to about 1.5%, by weight. Preferred levels of diethylene glycol include from about 0.1% to about 2%, and more preferably from about 0.1% to about 1%. It should be understood that other humectants beyond diethylene glycol can be used without departing from the scope of the invention. Also, preferred levels of cyclodextrin include from about 0.1% to about 4%, and more preferably, from about 0.5% to about 2% by weight. Preferred cyclodextrins include those selected from the group consisting of beta-cyclodextrin, alpha-cyclodextrin, gamma-cyclodextrin, derivatives of said cyclodextrins, and mixtures thereof. The cyclodextrin derivatives are preferably selected from the group consisting of methyl substituted cyclodextrins, ethyl substituted cyclodextrins, hydroxyalkyl substituted cyclodextrins, branched cyclodextrins, cationic cyclodextrins, quaternary ammonium cyclodextrins, anionic cyclodextrins, amphoteric cyclodextrins, cyclodextrins wherein at least one glucopyranose unit has a 3–6-anhydro-cyclomalto structure, and mixtures thereof.

Preferred levels of the surfactant include from about 0.1% to about 2%, more preferably from about 0.1% to about 0.5%, by weight. The preferred surfactant is polyalkylene oxide-modified polydimethylsiloxane, and can be purchased commercially from Witco Corporation under the tradename Silwet L-7600. A preferred optional ingredient is a preservative such as Kathon, commercially available from Rohm & Haas Company at a level of from about 0.0001% to about 0.0%. Other optional ingredients include perfumes, pH control agents, and alcohol. In this preferred polymer-containing composition, the pH is from about 6.5 to about 10, most preferably at about 9.5. In some cases where polymers are not included in the composition, the pH can vary from about 4 to about 10.

The following Example further illustrates the present invention, but are not to be considered limiting thereof.

EXAMPLES I–II

These Examples illustrate compositions of the invention and an exemplary use of such compositions. The compositions may be used to treat three oxford 100% cotton dress shirts which are hung on a horizontal rod in a 60 cm×30 cm×120 cm cabinet having a lower housing containing a fan and heater so that air can be continuously circulated throughout the cabinet. A Model No. 1050 air atomization spray nozzle from Spray Systems Inc. is used to convert the conditioning composition to fog form. The ingredients and relative proportions of the compositions are set forth below.

| Ingredient | I (% Weight) | II (% Weight) |
|---|---|---|
| Copolymer[1] | 0.75 | — |
| Diethylene glycol | 0.4 | 0.3 |
| β-hydroxylpropyl cyclodextrin | 1.0 | 1.0 |
| Polyalkylene oxide[2] | 0.25 | 0.25 |
| Sodium hydroxide | 0.1 | — |
| Preservative[3] | 0.0003 | 0.0003 |
| pH adjustment with HCl or NaOH | 9.5 | 4.0 |
| Water | to balance | to balance |

[1]Copolymer of acrylic acid and t-butylacrylate.
[2]Polyalkylene oxide modified polydimethylsiloxane commercially available from Witco Corporation under the tradename Silwet L-7600.

The above conditioning compositions are converted to fog form at ambient temperature with 20 psi (1.4 kg·cm$^2$) of air through the air atomization nozzle. The mean particulate diameter size of the fog is about 10.5 microns. Typical conditioning operations will last for 25 minutes, after which a drying operation may occur. The garments which have been exposed to the conditioning composition are deodorized, refreshed, and dewrinkled in an unexpectedly improved fashion as compared to compositions outside the scope of the invention, for example those compositions which are in liquid form.

Accordingly, having thus described the invention in detail, it will be obvious to those skilled in the art that various changes may be made without departing from the scope of the invention and the invention is not to be considered limited to what is described in the specification.

What is claimed is:

1. A non-steam treated garment conditioning, deodorizing composition comprising an aqueous mixture containing a garment conditioning agent selected from the group consisting of cyclodextrin, perfumes and mixtures thereof, wherein said aqueous mixture has a fluid viscosity of from about 1 cps to about 100 cps and a fluid surface tension of from about 20 dynes/cm to about 55 dynes/cm, said aqueous mixture being in fog particle form and wherein said cyclodextrin conditioning agent comprises from about 0.01% to about 10% by weight of cyclodextrin.

2. The composition of claim 1 wherein said fog includes particles having a mean particulate diameter size of from about 3 microns to about 50 microns.

3. The composition of claim 1 wherein said fog has a temperature of from about 20° C. to about 80° C.

4. The composition of claim 1 wherein said fog has a mean particulate diameter size of from about 5 microns to about 30 microns.

5. The composition of claim 1 wherein said conditioning agent further comprises a copolymer of acrylic acid and t-butylacrylate.

6. The composition of claim 5 wherein said copolymer of acrylic acid and t-butylacrylate is silicone grafted.

7. The composition of claim 1 wherein said conditioning agent further comprises from about 0.001% to about 10% by weight of diethylene glycol.

8. The composition of claim 1 wherein said cyclodextrin is a beta cyclodextrin.

9. The composition of claim 1 wherein said conditioning agent further comprises from about 0.001% to about 5% by weight of a surfactant.

10. The composition of claim 1 wherein said conditioning agent is a perfume.

11. The composition of claim 1 wherein said aqueous mixture further comprises a preservative.

12. The composition of claim 1 wherein the pH of said composition is from about 4 to about 10.

13. The composition of claim 1 wherein the pH of said composition is from about 6.5 to about 10.

* * * * *